US005192069A

United States Patent [19]

Seymour et al.

[11] Patent Number: 5,192,069

[45] Date of Patent: Mar. 9, 1993

[54] DOCUMENT FEEDER EMPLOYING A BELT

[75] Inventors: Kenneth S. Seymour, Conestogo; Dennis T. Sonnenburg, Waterloo, both of Canada

[73] Assignee: NCR Corporation, Dayton, Ohio

[21] Appl. No.: 846,091

[22] Filed: Mar. 5, 1992

[51] Int. Cl.[5] ..... B65H 3/04

[52] U.S. Cl. ..... 271/35; 271/121

[58] Field of Search ..... 271/34, 35, 121, 124; 221/253; 414/797.6

[56] References Cited

U.S. PATENT DOCUMENTS

| | | | |
|---|---|---|---|
| 1,955,066 | 4/1934 | Hiller | 271/35 |
| 1,976,788 | 10/1934 | Kurth | 271/35 |
| 4,014,537 | 3/1977 | Stange | 271/35 |
| 4,312,503 | 1/1982 | Saxinger et al. | 271/34 |
| 4,494,745 | 1/1985 | Ward et al. | 271/35 |
| 4,579,332 | 4/1986 | Larson | 271/35 |

FOREIGN PATENT DOCUMENTS 2719182 11/1978 Fed. Rep. of Germany ..... 271/34

*Primary Examiner*—H. Grant Skaggs

*Attorney, Agent, or Firm*—Elmer Wargo

[57] ABSTRACT

An apparatus for feeding documents from a stack of documents, in single file, into a document track, with the apparatus employing an endless belt. The endless belt is mounted on a drive roller and an idler roller to provide a linear portion of the belt which is parallel to the first document to be fed from the stack. The apparatus also includes a retard mechanism which includes a first portion to engage the documents in the stack and also includes a second portion which is parallel to the linear portion of the endless belt and is biased towards the linear portion by a tension spring. The endless belt is made of a material which is designed to wear instead of "glazing" which provides for a positive feed. The endless belt and the retard member are designed to be replaced by an operator of the terminal in which the apparatus is located so as to avoid a service call by a maintenance person.

6 Claims, 3 Drawing Sheets

DOCUMENT FEEDER EMPLOYING A BELT

CROSS REFERENCE TO RELATED APPLICATIONS

This application is related to copending application entitled, "DOCUMENT FEEDER EMPLOYING A VARIABLE LOAD APPLICATOR AND AN ENDLESS BELT", by Ken Seymour, Dennis Sonnenburg, and Joseph Guido, which application was filed on the same date as the present application and was assigned to the same assignee as the present application.

BACKGROUND OF THE INVENTION (1) Field of the Invention.

This invention relates to an apparatus for feeding documents from a stack of documents, in single file, into a document track, with the apparatus employing an endless belt.

(2) Background Information.

The purpose of a document feeder of the type mentioned is to separate or pick a document from a stack of documents in a hopper and feed it at a particular rate with an inter-document gap between documents to a downstream module like a reader, encoder, endorser, microfilmer, or a pocket module, for example.

Feeding a single document from a stack of documents generally requires advancing the first document in the stack, while inhibiting the remainder of the documents in the stack by a retard mechanism. edge of the prior document which was just removed from the stack.

In some prior art designs, the retard mechanism used a roller which operated in a direction which was opposite to the direction of the associated feed roller. Such a design generally required a separate motor for the feed roller and a separate motor for the retard roller.

When feed and retard rollers are used, it is generally necessary to be very precise in the adjustment of the rollers relative to each other. As the rollers begin to wear, additional maintenance or adjustment is necessary. Replacing such feed and retard rollers, when excessively worn, generally ; requires that the maintenance be done by a service person. Very often, the feed and retard rollers become "glazed" or slippery in use, and consequently, they lose their effectiveness.

SUMMARY OF THE INVENTION

The objects of this invention are to provide a document feeding apparatus which:

1. Is simple and inexpensive to manufacture;
2. Minimizes the amount of adjustment required for the associated parts; and
3. Is designed to cause certain parts to wear so as to avoid the "glazing" mentioned, with these certain parts being easily replaceable.

In a preferred embodiment of this invention, there is provided an apparatus for feeding documents comprising:

a hopper for storing a stack of documents to be fed, said hopper having an alignment side and a stop;

feed means for moving the documents in the hopper along said alignment side towards the stop;

a drive roller and an idler roller having an endless belt mounted thereon to provide a linear portion of the endless belt parallel to a first document to be picked from the stack, with said linear portion engaging the first document to be picked;

a retard mechanism positioned adjacent said alignment side and in opposed relationship with said linear portion of said endless belt;

said retard mechanism having a retard member including a first portion to engage the documents in said stack and also having a second portion substantially parallel to said linear portion to permit only one document to be moved towards a document track by said linear portion of said endless belt, said first and second portions forming a wiper; and a resilient member to bias said second portion towards said linear portion of said endless belt.

The above objects and advantages to be described will become more apparent upon a review of the following specification, claims, and drawing.

DESCRIPTION OF THE PREFERRED EMBODIMENT

Figure 1:
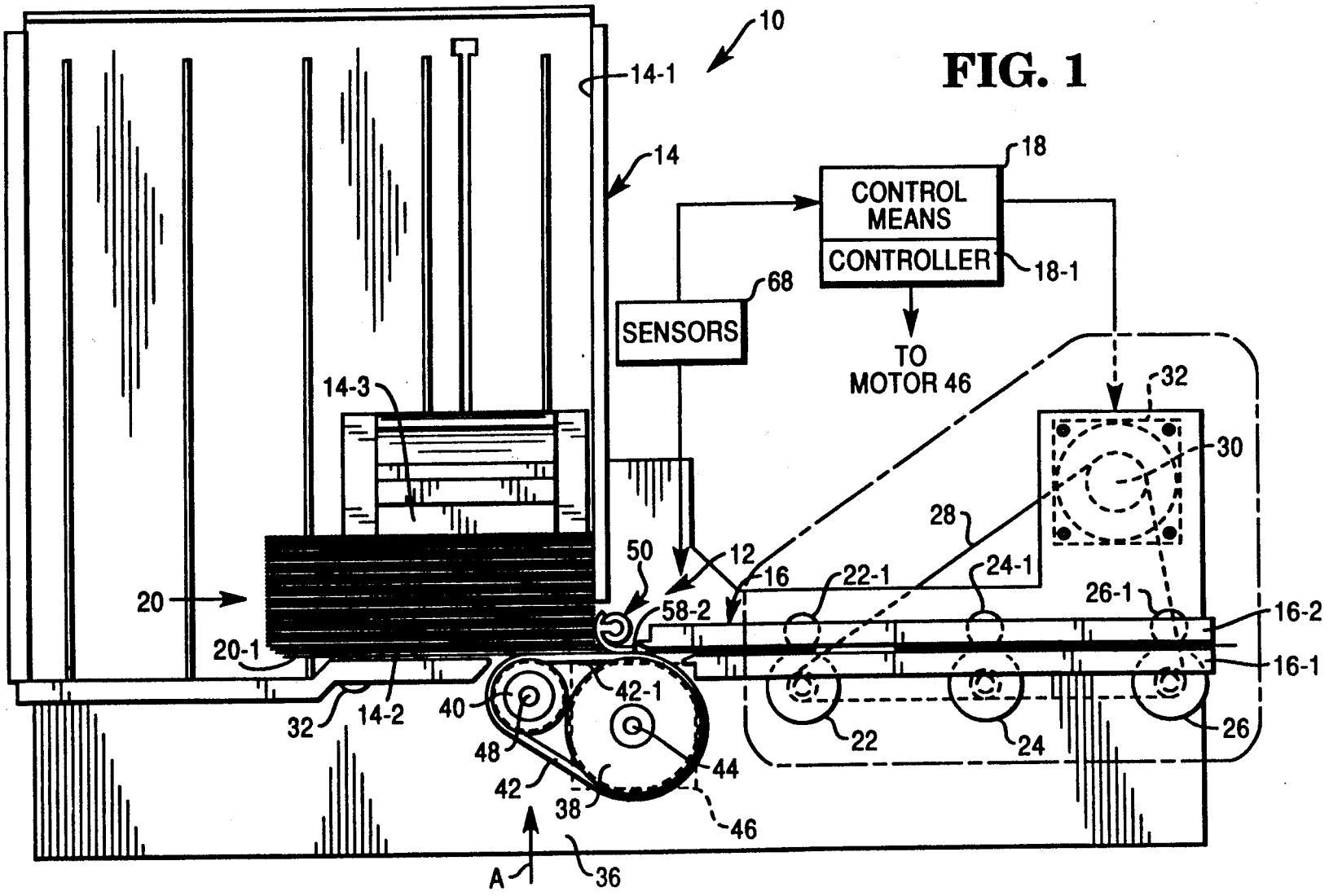
FIG. 1 is a plan view of the top of a terminal which includes the apparatus of this invention, showing a feeding means including an endless belt for feeding documents from a stack to a document track.

FIG. 1 is a plan view of a business machine or terminal 10 in which the apparatus 12 of this invention may be incorporated. The terminal 10 may be an encoder, for example, or other machine mentioned earlier herein. The terminal 10 includes a hopper 14, a document track 16, and a control means 18 for controlling the operation of the terminal 10.

The function of the apparatus 12 is to pick a first document 20-1 from a stack 20 of documents which are located in the hopper 14 and to feed the first document 20-1 into the document track 16 which has first and second upstanding side walls 16-1 and 16-2. This process is repeated for the next first document 20-1 in the stack 20 until the entire stack 20 of documents is fed into the document track 16. While the documents in the stack 20 are shown as being of the same size, this is merely a matter of convenience. In reality, a stack of documents can vary in length from about 4 inches to a length of about 9 inches, for example. The top long edge of each document in the stack 20 of documents is shown in FIG. 1.

The terminal 10 also includes feed rollers 22, 24, and 26 which are driven or rotated by an endless belt 28 which is coupled to a drive pulley 30 of a motor 32 which is controlled by the control means 18. The feed rollers 22, 24, and 26 have associated pinch rollers 22-1, 24-1 and 26-1 to conventionally move a document, like 20-1, in a downstream direction, which is to the right as viewed in FIG. 1. Additional modules, like an endorsing station or an encoding station (not shown) may be located downstream of the feed roller 26, for example.

The hopper 14 (FIG. 1) is designed to move a stack 20 of documents along an alignment side 14-1 towards a stop 14-2. A pusher 14-3 resiliently biases the stack 20 of documents towards the stop 14-2. The hopper 14 may employ gravity and a member (like a spring loaded bar 14-3) to perform the movement indicated. The stop 14-2 has an idler roller 32 rotatably mounted therein and protruding from the stop 14-2 towards the stack 20 of documents to minimize any friction between the stop 32 and the stop 14-2. The idler roller 32 is rotatably mounted on a rod 34 (FIG. 3) which is upstanding from a frame 36 of the terminal 10.

The purpose of the apparatus 12 is to pick the documents in the stack 20, one at a time, and feed them at a specific rate, with a gap between successive documents being fed, to the document track 16, which in turn, feeds the documents to a module, like an endorser, for example, which is not shown.

The apparatus 12 includes a drive roller 38 (FIGS. 1 and 3) and an idler roller 40 which have an endless belt 42 mounted thereon. The drive roller 38 is coupled to the output shaft 44 of a motor 46 to be rotated thereby. The motor 46 is secured to the frame 36, and operates under the control of the control means 18. The drive roller 38 and the idler roller 40 have flanges 38-1 and 40-1 which retain the endless belt 42 on the associated rollers. The idler roller 40 is rotatably supported on a rod which is upstanding from the frame 36.

Figure 3:
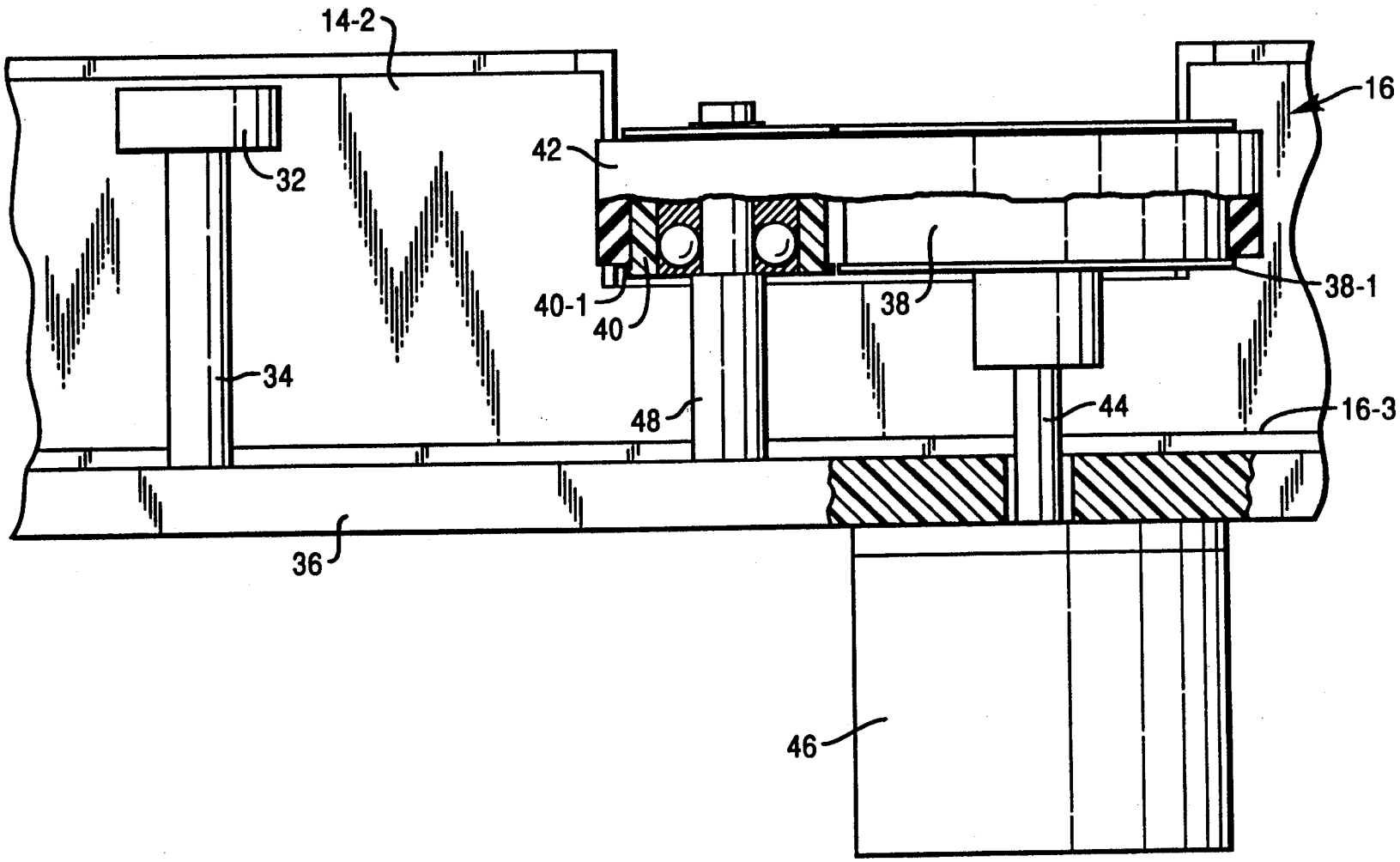
FIG. 3 is an elevational view, looking from the direction of arrow A of FIG. 1 to show additional details of a means for mounting the endless belt shown in FIG. 1.

The drive roller 38 and the idler roller 40 are positioned in the frame 36 (FIG. 1) so that the endless belt 42 has a straight or linear portion 42-1 which is parallel to the first document 20-1 to be described, the endless belt 42 is positioned so that the centerline of its width is about 1.3 inches above the bottom 16-3 of the document track 16 as measured in a vertical direction, as viewed in FIG. 3. The width of the endless belt 42 is ¾ inch in the embodiment described. Naturally, the specific dimensions and locations of the endless belt 42 can be changed to suit particular applications.

Figure 4:
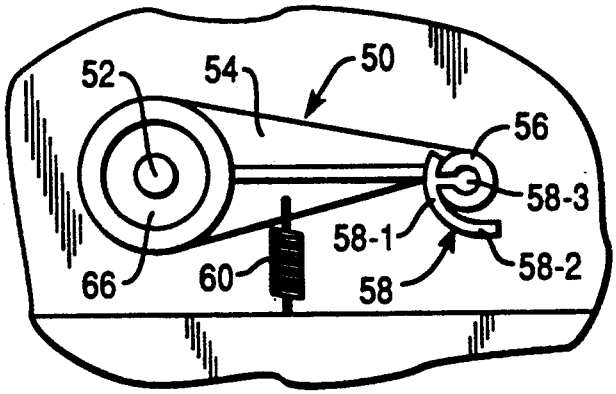
FIG. 4 is an enlarged, plan view of a retard mechanism shown in FIG. 1.

The apparatus 12 also includes a retard mechanism 50 shown in FIGS. 1 and 4. The retard mechanism 50 functions as a wiper and cooperates with the feed means including the endless belt 42 to permit only one document at a time to be fed from the stack 20 of documents to the document track 16.

The retard mechanism 50 includes a support post 52 (FIG. 4) and an arm 54, having one end pivotally mounted on the support post 52, with the remaining or free end having a cylindrical portion 56 which is "C"-shaped in cross section. The retard mechanism 50 also has a retard member 58 which has a first portion 58-1 which engages the stack 20 of documents as shown in FIG. 1, and it also has a second portion 58-2 which is biased towards the linear portion 42-1 of the endless belt 42 by the tension spring 60 shown in FIG. 4. The retard member 58 also has a complementary member 58-3 which extends therefrom to enable the retard member 58 to be mounted on the arm 54 by having the complementary member 58-3 slide into the cylindrical portion 56. The support post 52 and the arm 54 are located below the hopper 14, and the retard member 58 is positioned in the of the retard member 58 is opposite to and is biased towards the linear portion 42-1 of the endless belt 42.

Figure 2:
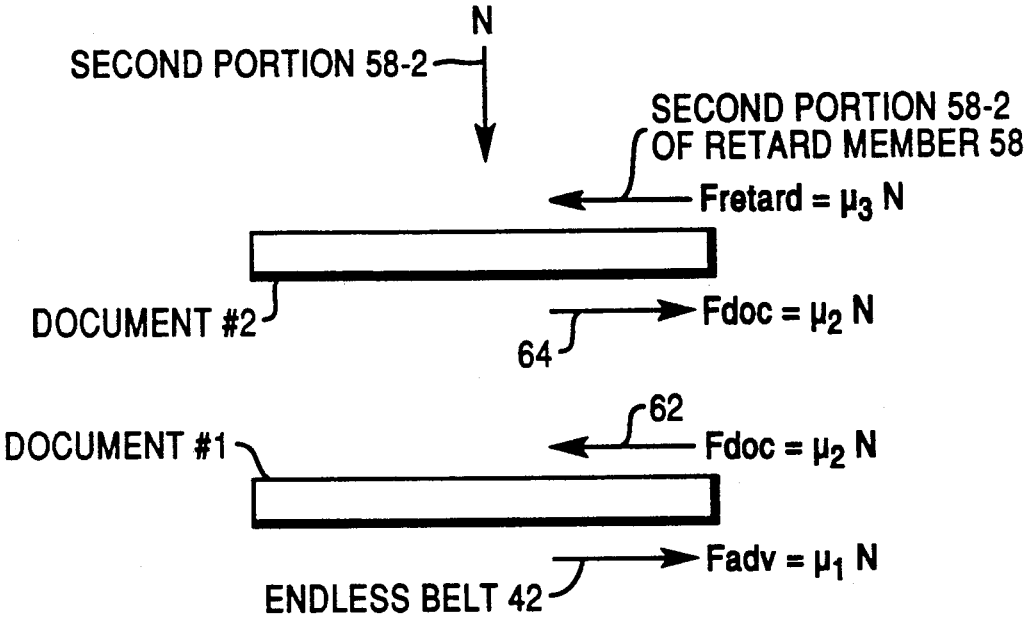
FIG. 2 is a schematic diagram showing a relationship among various friction forces associated with the apparatus of this invention.

Before discussing the operation of the apparatus 12, it is useful to discuss the friction which exists between certain members of the apparatus 12. In this regard, FIG. 2 shows the various forces working on a document to be fed from the stack 20 of , documents and moved to the document track 16. In effect, the documents are separated by differential friction. The second portion 58-2 of the retard member 58 applies a force N (via the spring 60) which is normal or perpendicular to the linear portion 42-1 of the endless belt 42, and the second portion 58-2 also has a coefficient of friction (COF)which is $u_3$.

The relationship of the COF of each of the members is as follows. The endless belt 42 (FIG. 2) has the highest COF which is equal to $u_1$; the second portion 58-2 of the retard member 58 has the next highest COF which is equal to $u_3$; and the COF of the documents in the stack 20 of documents is equal to $u_2$. Because the endless belt 42 has the highest COF, the force Fadv is the highest, and it is sufficient to drive the document #1 to the right as shown in FIG. 2, while the second portion 58-2 of the retard member 58 provides a force Fretard which is sufficient to stop the second document #2 from being fed to the right. There are inter-document forces Fdoc (shown by arrows 62 and 64).

These are some considerations which follow from the various forces due to friction shown in FIG. 2:

1. If the inter-document friction or force Fdoc is too high or the retard friction Fretard is too low, multiple feeding of the documents results; and
2. If the retard friction Fretard is too high or the advance friction Fadv is too low, the documents won't feed.

A major part of the design of the apparatus 12 is to ensure that there is no slippage between the endless belt 42 and the document #1 in FIG. 2; this document corresponds to the first document 20-1 in the stack 20 of documents. Relative slip between the 1 document #1 and the endless belt 42 leads to "glazing" of the endless belt 42, and glazing of this belt leads to slippage and a loss of document throughput. Maintaining the required friction of the endless belt 42 is a key to ensuring a successful design. , A problem with the documents in the stack 20 of documents is that in addition to coming in a variety of sizes, the documents have varying paper properties. Some of these variations relate to type of paper, thickness, texture, humidity, and surface contaminants, like inks and waxes. Previously, replacement of parts was not necessitated, generally, by wear but by a loss of friction. It is a feature of the present invention that in order to maintain a high friction surface, a controlled amount of wear is desirable in the endless belt 42.

Several endless belts, like 42, were tried for the endless belt 42. The material which was found to work the best was a rubber type belt which has some proprietary elements in it. The particular endless belt 42 used is a "Posifeed 3570" belt which is manufactured and currently available from the Siegling Co. of Charlotte, North Carolina. This particular belt wears out without "glazing." Naturally, other belts possessing these characteristics may be used. Another feature of the apparatus 12 is that when the endless belt 42 wears out, it is easy for an operator to replace the endless belt 42 with a new one. A service call by a maintenance person is not necessary to effect the change.

The material for the retard member 58, in contrast, is made of a material, like urethane, which yields low wear. The cantilever design of the retard member 58 gives some flexibility to the relatively stiff material from which it is made. The flexibility of the second portion 58-2 enables this portion to conform to the linear portion 42-1 of the endless belt 42 without having to maintain tight tolerances between these elements. The arm 54 has a bearing 66 (FIG. 4) in its first end to enable the arm to freely rotate on the support post 52. The spring 60 keeps a sufficient normal force N (FIG. 2) on the endless belt 42. Variations due to wear on the retard member 58 and the endless belt 42 are thereby compensated for by the action of spring 60.

The design of the retard mechanism 50 also permits a sufficient "footprint" or area on the rear of the document to perform the restraining function. The retard member 58 can also be replaced, easily, by an operator instead of a service person by simply pulling up on the retard member 58, as viewed in FIG. 4, to remove it, and pushing down on a new one to push it in place. The retard member 58 is also designed to provide a "lead-in" from the first portion 58-1 to the second portion 58-2 for leading the documents into the document track 16.

The apparatus 12 includes the necessary sensors 68 (shown schematically) which are positioned along the document track 16 to give an indication of the leading and trailing edges of the documents as is conventionally done. A first sensor 68 is located just upstream from the feed roller 22 to monitor the inter-space distance between the trailing edge of one document (the one just picked) and the leading edge of the next successive document. Another sensor 68 is located just downstream from feed roller 26 to monitor the inter-space distance between the documents leaving the apparatus 12, assuming the documents are moving downstream away from the apparatus 12 at a known constant speed.

When the motor 46 is stepped or rotated, the first document 20-1 is picked from the stack 20 and moved to the right as viewed in FIG. 1. The retard member 58 then functions to permit only the first document 20-1 to be moved to the document track 16, as previously described. The inter-space distance is achieved by picking the document much more slowly than the speed of the document in the document track 16, thus allowing the trailing edge of the document just picked to move away from the leading edge of the next successive document. When the leading edge of the document just picked is detected at the sensor 68 near the feed roller 26, both motors 46 and 30 are stopped, if necessary, to provide the appropriate inter-space distance between the trailing edge of one document (the one downstream from the apparatus 12) and the next successive document (the one just picked). When the appropriate inter-space distance is reached, both motors 46 and 30 are again energized or stepped to feed the next document.

The speed of motor 30 is determined by the required speed of the documents leaving the apparatus 12. It is desirable to pick documents as slowly as possible while still maintaining the required documents per minute feed rate. Accordingly, after each document 20-1 is picked, if the inter-space distance is too large, the speed of the document picking motor 46 is increased by approximately 1%. If the inter-space distance is too small, the speed of the document picking motor 46 is decreased by approximately 1%. The picking speed is thus varied by the controller 18-1 between the limits of 46% and 60% of the speed of a document moving in the document track 16 and will tend to seek an optimum speed. This process is repeated until all the documents in the stack 20 of documents has been fed.

What is claimed is:

1. An apparatus for feeding documents comprising:

a hopper for storing a stack of documents to be fed in a substantially vertical plane, said hopper having an alignment side and a stop;

feed means for moving the documents in the hopper along said alignment side towards the stop;

a drive roller and an idler roller having an endless belt mounted thereon to provide a linear portion of the endless belt parallel to the first document to be picked from the stack, with said linear portion engaging the first document to be picked;

a retard mechanism positioned adjacent said alignment side and in opposed relationship with said linear portion of said endless belt;

said retard mechanism having a retard member including a first portion to engage the documents in the stack and also having a second portion substantially parallel to said linear portion to permit only one document to be moved towards a document track by aid linear portion of said endless belt; and a resilient member to bias said second portion towards said lien ar portion of said endless belt;

said stop being aligned with said linear portion of said endless belt, and said idler roller being positioned between said stop and said retard mechanism.

2. The apparatus as claimed in claim 1 in which said endless belt is made of an elastomeric material which wears without glazing in use.

3. The apparatus as claimed in claim 2 in which said endless belt is made of materials comprising a Posifeed 3570 belt.

4. The apparatus as claimed in claim 2 in which said endless belt has a coefficient of friction which is greater than the coefficient of friction of said second portion of said retard mechanism.

5. The apparatus as claimed in claim 4 in which said hopper has an idler roller protruding from said stop to engage said stack of documents.

6. The apparatus for feeding documents comprising:

a hopper for storing a stack of documents to be fed, said hopper having an alignment side and a stop;

feed means for moving the documents in the hopper along said alignment side towards the stop;

a drive roller and an idler roller having an endless belt mounted thereon to provide a linear portion of the endless belt parallel to the first document to be picked from the stack, with said linear portion engaging the first document to be picked;

a retard mechanism positioned adjacent said alignment side and in opposed relationship with said linear portion of said endless belt;

said retard mechanism having a retard member including a first portion to engage the documents in the stack and also having a second portion substantially parallel to said linear portion to permit only one document to be moved towards a document track by said linear portion to said endless belt; and a resilient member to bias said second portion towards said linear portion of said endless belt;

said endless belt being made of an elastomeric material which wears without glazing in use;

said first and second portions forming a wiper and in which said retard mechanism comprises:

a support post;

an arm having one end pivotally mounted on said support post and also having a free end;

said free end having a cylindrical portion which is "C-shaped" in cross section;

said first portion of said retard mechanism having a complementary member thereon to fit into said cylindrical portion to mount said wiper on said free end of said arm.

* * * * *

UNITED STATES PATENT AND TRADEMARK OFFICE

CERTIFICATE OF CORRECTION

PATENT NO. : 5,192,069

DATED : March 9, 1993

INVENTOR(S) : Kenneth S. Seymour et al.

It is certified that error appears in the above-identified patent and that said Letters Patent is hereby corrected as shown below:

Column 6, line 16, "aid" should be --said--.

Column 6, line 18, "lien ar" should be --linear--.

Signed and Sealed this

Twenty-third Day of November, 1993

*Attest:*

*Attesting Officer*

Bruce Lehman

BRUCE LEHMAN

*Commissioner of Patents and Trademarks*